US011821274B2

(12) United States Patent
Xie et al.

(10) Patent No.: US 11,821,274 B2
(45) Date of Patent: Nov. 21, 2023

(54) MOON-BASED IN-SITU CONDITION-PRESERVED CORING MULTI-STAGE LARGE-DEPTH DRILLING SYSTEM AND METHOD THEREFOR

(71) Applicants: SHENZHEN UNIVERSITY, Guangdong (CN); SICHUAN UNIVERSITY, Sichuan (CN)

(72) Inventors: Heping Xie, Shenzhen (CN); Mingzhong Gao, Shenzhen (CN); Ling Chen, Shenzhen (CN); Guoqing Zhang, Shenzhen (CN); Jianan Li, Shenzhen (CN); Jianbo Zhu, Shenzhen (CN); Cunbao Li, Shenzhen (CN)

(73) Assignees: SHENZHEN UNIVERSITY, Shenzhen (CN); SICHUAN UNIVERSITY, Chengdu (CN)

( * ) Notice: Subject to any disclaimer, the term of this patent is extended or adjusted under 35 U.S.C. 154(b) by 73 days.

(21) Appl. No.: 17/433,335

(22) PCT Filed: Jul. 5, 2019

(86) PCT No.: PCT/CN2019/094895
§ 371 (c)(1),
(2) Date: Aug. 24, 2021

(87) PCT Pub. No.: WO2020/258367
PCT Pub. Date: Dec. 30, 2020

(65) Prior Publication Data

US 2022/0042386 A1 Feb. 10, 2022

(30) Foreign Application Priority Data

Jun. 27, 2019 (CN) ..... 201910569506.7

(51) Int. Cl.
*E21B 25/00* (2006.01)
*E21B 49/02* (2006.01)
(Continued)

(52) U.S. Cl.
CPC ..... *E21B 25/00* (2013.01); *E21B 6/02* (2013.01); *E21B 19/086* (2013.01); *E21B 49/02* (2013.01); *E21C 51/00* (2013.01)

(58) Field of Classification Search
CPC ..... E21B 49/02; E21B 25/00; E21B 19/086; E21B 6/04; E21B 6/08
See application file for complete search history.

(56) References Cited

U.S. PATENT DOCUMENTS

2003/0209092 A1 11/2003 Ng et al.

FOREIGN PATENT DOCUMENTS

CN 101936822 A 1/2011
CN 102359891 A 2/2012
(Continued)

OTHER PUBLICATIONS

International Search Report dated Mar. 27, 2020 in corresponding International Application No. PCT/CN2019/094895; 8 pages.

*Primary Examiner* — Robert E Fuller
(74) *Attorney, Agent, or Firm* — Maier & Maier, PLLC

(57) ABSTRACT

A moon-based in-situ condition-preserved coring multi-stage large-depth drilling system and method therefor. The system includes a rotary plate provided inside a lander, an in-situ condition-preserved coring tool provided on a surface of the rotary plate, a space frame provided on a surface of the rotary plate, a working platform provided on a top of the space frame, a mechanical arm provided on a bottom surface of the working platform, and a camera provided on the bottom surface of the working platform, the mechanical arm is fixedly connected to the working platform, and the camera
(Continued)

is fixedly connected to the working platform. By controlling the mechanical arm to place the in-situ condition-preserved coring tool on the moon surface, and using the in-situ condition-preserved coring tool to sample the lunar soil on the moon surface, the coring operation problem of the lunar soil is solved.

10 Claims, 4 Drawing Sheets

(51) Int. Cl.

| | |
|---|---|
| ***E21C 51/00*** | (2006.01) |
| ***E21B 6/02*** | (2006.01) |
| ***E21B 19/086*** | (2006.01) |

(56) References Cited

FOREIGN PATENT DOCUMENTS

| | | | |
|---|---|---|---|
| CN | 103837373 | A | 6/2014 |
| CN | 105510078 | A | 4/2016 |
| CN | 106198100 | A | 12/2016 |
| CN | 109506974 | A | 3/2019 |
| RU | 2501952 | C1 | 12/2013 |

MOON-BASED IN-SITU CONDITION-PRESERVED CORING MULTI-STAGE LARGE-DEPTH DRILLING SYSTEM AND METHOD THEREFOR

CROSS-REFERENCES TO RELATED APPLICATIONS

This application is a national application of PCT application No. PCT/CN2019/094895, filed on Jul. 5, 2019, which claims priority to Chinese Patent Application No. 201910569506.7, filed on Jun. 27, 2019, the content of all of which is incorporated herein by reference.

FIELD

The present disclosure relates to the technical field of moon exploration, and more particularly, to a multi-stage large-depth drilling system and method for moon-based in-situ condition-preserved coring.

BACKGROUND

Deep space exploration is an inevitable direction for future development, and the Moon is a celestial body closest to our mankind. The Moon is rich in a plurality of mineral resources including iron, titanium and uranium, as well as the famous helium-3 gas energy source. A sample from lunar surface can be regarded as priceless. Therefore, moon drilling is of a great strategic significance for a plurality of problems including researching a material composition of the lunar surface, an origin of the moon, a phenomenon of the Earth climate and tidal flood, and a plurality of resources in future.

Unlike a conventional land-based drilling activity, a lunar drilling activity faces a number of challenges. Due to an effect of a plurality of complex environments on lunar surface including a high vacuum, a strong radiation, a large temperature difference between day and night, and a high absorbability and friction of lunar soil, a plurality of work on collection, excavation, and transportation of the lunar soil are all facing a plurality of great challenges, especially achieving a drilling operation in an in-situ condition-preserved state that needs to keep a sample in an original state thereof.

Accordingly, the prior art needs to be improved and developed.

SUMMARY

An object of the present disclosure is providing a multi-stage large-depth drilling system and method for moon-based in-situ condition-preserved coring, aiming at solving a problem of coring the lunar soil, realizing an operation of collecting, excavating and transporting the lunar soil in an in-situ condition-preserved state, and increasing a sampling amount of coring the lunar soil.

The above technical object of the present disclosure is achieved by the following technical solution:

In one aspect, the present disclosure provides a multi-stage large-depth drilling system for moon-based in-situ condition-preserved coring, including: a rotary plate arranged inside a lander and rotatably connected to the lander, an in-situ condition-preserved coring tool arranged on a surface of the rotary plate which is configured to sample the lunar soil, a space frame disposed on the surface of the rotary plate and fixedly connected to the rotary plate, a working platform arranged on a top of the space frame and rotatably connected to the space frame, a mechanical arm arranged on a bottom surface of the working platform which is configured to grasp the in-situ condition-preserved coring tool, and a camera arranged on a bottom surface of the working platform which is configured to observe moon surface; the mechanical arm is fixedly connected to the working platform, and the camera is fixedly connected to the working platform.

Further, the mechanical arm is a multi-degree-of-freedom mechanical arm, a tail of the mechanical arm has a hardness sensor arranged, configured to detecting a surface hardness of the lunar soil, and the hardness sensor is fixedly connected to the mechanical arm.

Further, the in-situ condition-preserved coring tool comprises a tool body, a multi-stage overlapping hydraulic cylinder mechanism, a motor driving mechanism, an ultrasonic shock power mechanism, an external drilling mechanism, and an internal drilling mechanism;

the multi-stage overlapping hydraulic cylinder mechanism is fixedly connected to the tool body; the motor driving mechanism is fixedly connected to the multi-stage overlapping hydraulic cylinder mechanism; the ultrasonic shock power mechanism is fixedly connected to the multi-stage overlapping hydraulic cylinder mechanism; the external drilling mechanism is fixedly connected to the motor driving mechanism; the internal drilling mechanism is fixedly connected to the ultrasonic shock power mechanism.

Further, the multi-stage overlapping hydraulic cylinder mechanism comprising a hollow servo cylinder, a pneumatic servo cylinder, a connection shell, and a drilling pressure sensor;

the hollow servo cylinder is arranged on both sides of the pneumatic servo cylinder, and the hollow servo cylinder is fixedly connected to the tool body; a bottom of the pneumatic servo cylinder is fixedly connected to a base of the hollow servo cylinder; the connection shell is fixedly connected to a push rod of the hollow servo cylinder; the drilling pressure sensor is fixedly connected to the connection shell.

Further, the motor driving mechanism comprises a driving housing, a hollow stator, a hollow rotor, and a thrust bearing set;

the driving housing is fixedly connected to the drilling pressure sensor; the hollow stator is fixedly connected to the driving housing; the thrust bearing set is fixedly connected to the hollow stator; the hollow rotor is fixedly connected to the thrust bearing set.

Further, the ultrasonic shock power mechanism comprises a connection rod, an upper cover plate, a piezoelectric ceramic, a lower cover plate, and a amplitude changing rod;

the connection rod passes through a center of the hollow rotor and the connection shell, and a top of the connection rod is fixedly connected to the push rod of the pneumatic servo cylinder; the upper cover plate is fixedly connected to the connection rod, the piezoelectric ceramic is fixedly connected to the upper cover plate, and the lower cover plate is fixedly connected to the piezoelectric ceramic; the amplitude changing rod is fixedly connected to the lower cover plate.

Further, the external drilling mechanism comprises an external drill housing and an external drill;

a top of the external drill housing is fixedly connected to the hollow rotor; the external drill is arranged at a bottom of the external drill housing and fixedly connected to the external drill housing.

Further, the internal drilling mechanism comprises an internal drill housing, an internal drill, a claw, and a sealing airbag;

the internal drill housing is fixedly connected to the amplitude changing rod; the internal drill is arranged at a bottom of the internal drill housing and fixedly connected to the internal drill housing; the claw is arranged on an internal wall of the internal drill housing and rotatably connected to the internal drill housing; the sealing airbag is arranged outside the claw and fixedly connected to the internal drill housing.

Further, a guiding support structure is arranged between the internal drill housing and the external drill housing, the guiding support structure is fixedly connected to the internal drill housing and slidably connected to the external drill housing.

In another aspect, the present disclosure further provides a multi-stage large-depth drilling method for moon-based in-situ condition-preserved coring, wherein comprising a plurality of following steps:

controlling a mechanical arm to grab an in-situ condition-preserved coring tool from a rotary plate and place the in-situ condition-preserved coring tool on moon surface when a lander receives a drilling signal transmitted from a launch base;

acquiring a signal output from a hardness sensor when the mechanical arm places the in-situ condition-preserved coring tool on the moon surface, and judging whether a hardness of a lunar soil on the moon surface meets a sampling standard according to the signal;

controlling a motor driving mechanism in the in-situ condition-preserved coring tool to operate when the hardness of the lunar soil on the moon surface meets the sampling standard, and using the motor driving mechanism to drive an external drilling mechanism to drill the lunar soil on the moon surface;

controlling an ultrasonic shock power mechanism in the in-situ condition-preserved coring tool to perform a shock when the external drilling mechanism encounters a hard rock layer during a drilling process, and using the ultrasonic shock power mechanism to drive an internal drilling mechanism to perform a coring on the hard rock layer;

storing a soil sample from the moon surface in the in-situ condition-preserved coring tool when the internal drilling mechanism completes coring, and controlling a rope device of the lander to retrieve the in-situ condition-preserved coring tool, before placing the in-situ condition-preserved coring tool back on the rotary plate.

The technical scheme adopted by the present disclosure has the following beneficial effects:

By arranging the rotary plate, the in-situ condition-preserved coring tool, the space frame, the working platform, the mechanical arm and the camera are arranged inside the lander, the present disclosure controls the mechanical arm to place the in-situ condition-preserved coring tool on the moon surface, and uses the in-situ condition-preserved coring tool to sample soil, rocks and more on the moon surface, before solving a problem of coring work on the lunar soil, and achieving the operation of collecting, excavating and transporting the lunar soil in an in-situ condition-preserved state, as well as increasing a sampling amount of the lunar soil coring.

DETAILED DESCRIPTION OF THE EMBODIMENTS

The present disclosure will now be described in further detail with reference to the accompanying drawings.

The embodiments are merely an explanation of the present disclosure, and not intended to limit the present disclosure. A person skilled in the art, after reading the present specification, may make modifications to the embodiments without inventive step as required, which are protected by the patent law as long as they are within the scope of the claims of the present disclosure.

Embodiment 1

Figure 1:
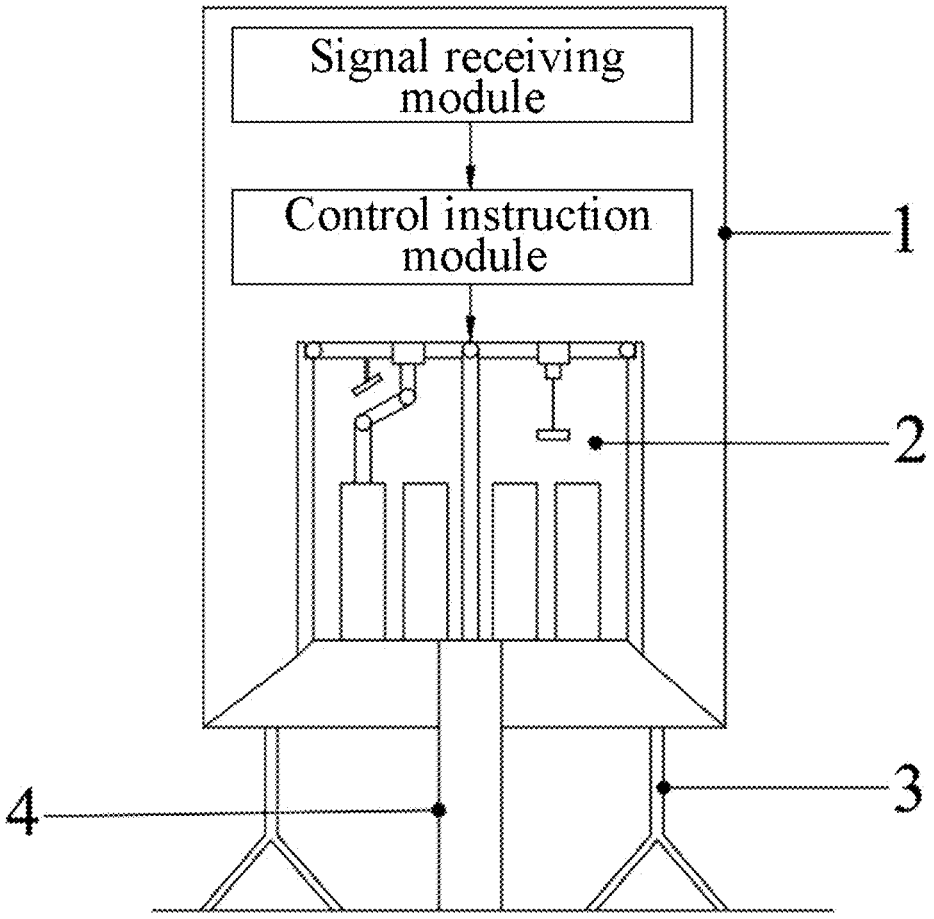
FIG. 1 illustrates a schematic diagram of a lander 1 according to an embodiment of the present disclosure.

As shown in FIG. 1, FIG. 1 illustrates a schematic diagram of a lander 1 in the present embodiment.

In the present embodiment, when the lander 1 lands on moon surface, the lander 1 is supported by a frame base 3 at a bottom of the lander 1. When excavating a soil on the moon surface is required, the lander 1 performs an exploration through a coring channel 4 at the bottom of the lander 1. The lander 1 has a signal receiving module and a control instruction module arranged thereon. The signal receiving module is configured to receive a signal transmitted from a launch base before converting the signal into a digital control program. The digital control program after conversion controls a moon-based in-situ condition-preserved coring multi-stage large-depth drilling system 2 inside the lander 1 to operate, by a control instruction output from the control instruction module.

Figure 2:
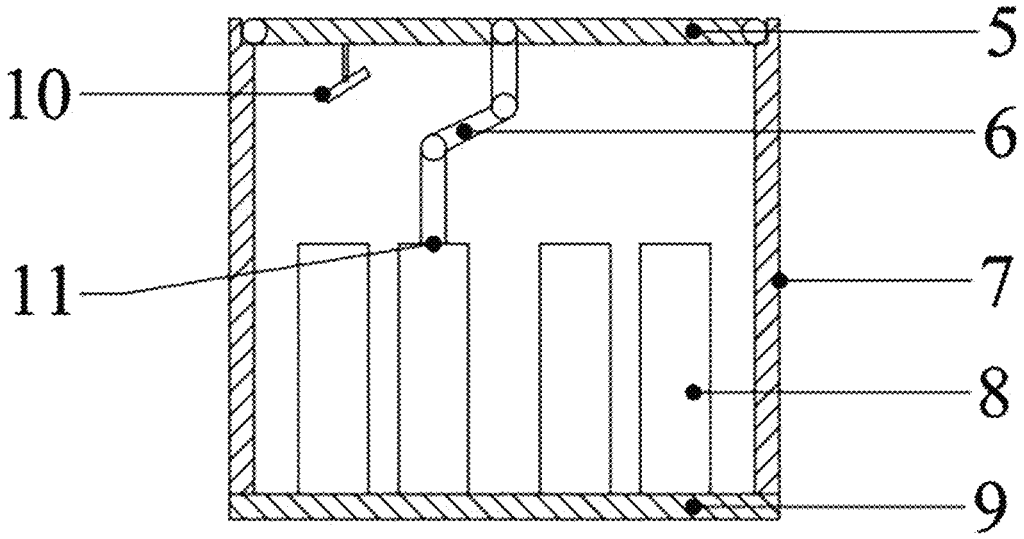
FIG. 2 illustrates a schematic diagram of a moon-based in-situ condition-preserved coring multi-stage large-depth drilling system 2 in FIG. 1.
Figure 3:
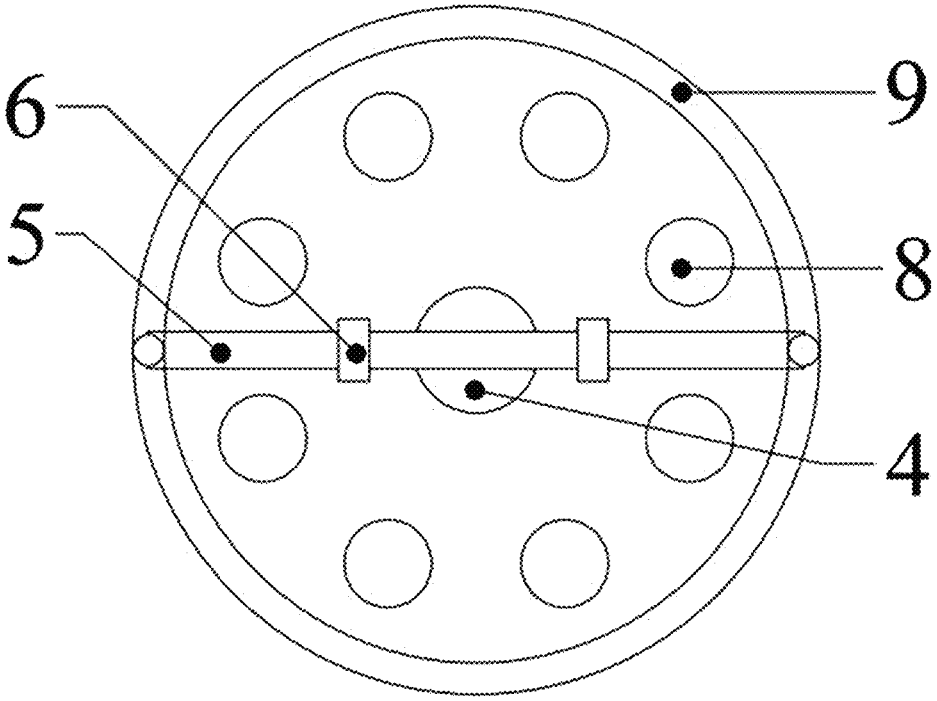
FIG. 3 illustrates a top view on a rotary plate 9 in FIG. 2.

As shown in FIG. 2 and FIG. 3, the moon-based in-situ condition-preserved coring multi-stage large-depth drilling system 2 provided in the present embodiment comprises a rotary plate 9, an in-situ condition-preserved coring tool 8, a space frame 7, a working platform 5, a mechanical arm 6, and a camera 10.

In the present embodiment, the rotary plate 9 is arranged inside the lander 1, and rotatably connected to the lander 1. When the rotary plate 9 needs to be turned, it is possible to drive the rotary plate 9 to a predetermined position by a motor at a bottom of the rotary plate 9. The number of the in-situ condition-preserved coring tools 8 is preferred to be eight, eight of the in-situ condition-preserved coring tools 8 are evenly arranged along a circumference of the rotary plate 9, and each of the in-situ condition-preserved coring tool 8 is fixed to a surface of the rotary plate 9 by a pneumatic clamping hand. When it is needed to use the in-situ condition-preserved coring tool 8, the pneumatic clamping hand is controlled to release and the in-situ condition-preserved coring tool 8 is clamped by the mechanical arm 6.

The space frame 7 is arranged on the surface of the rotary plate 9, and fixedly connected to the rotary plate 9. The working platform 5 is arranged on a top of the space frame 7, and rotatably connected to the space frame 7. When it is needed to change an orientation of the working platform 5, the working platform 5 can be driven by a motor at either end of the working platform 5, making the working platform 5 rotate on the space frame 7 about a central axis of the working platform 5.

The mechanical arm 6 is arranged on a bottom surface of the working platform 5, and fixedly connected to the working platform 5. In the present embodiment, the mechanical arm 6 is a multi-degree-of-freedom mechanical arm which can be used to clamp the in-situ condition-preserved coring tool 8 and move the in-situ condition-preserved coring tool 8 into the coring channel 4 at the bottom of the lander 1, so that the in-situ condition-preserved coring tool 8 is placed on the moon surface along the coring channel 4. The camera 10 is arranged on the bottom surface of the working platform 5, and fixedly connected to the working platform 5. The camera 10 may be configured to observe an operation state inside the moon-based in-situ condition-preserved coring multi-stage large-depth drilling system 2, to ensure a reliability thereof. At a same time, the camera 10 may further be used to observe the moon surface before finding a suitable sampling point.

In the present embodiment, the number of the mechanical arms 6 is two. Each of the mechanical arms 6 has a hardness sensor 11 arranged, which is fixedly connected to the mechanical arm 6. The hardness sensor 11 can be used to detect a hardness on a surface of the lunar soil. When the mechanical arm 6 clamps and places the in-situ condition-preserved coring tool 8 onto the moon surface, the hardness of the lunar soil on the moon surface is judged by a signal output from the hardness sensor 11.

In the present embodiment, a work principle of the moon-based in-situ condition-preserved coring multi-stage large-depth drilling system 2 is as follows:

After the lander 1 lands on the moon, the frame base 3 fixes the lander 1 onto the moon surface, and the launch base sends an instruction to control the lander 1 to run the moon-based in-situ condition-preserved coring multi-stage large-depth drilling system 2. When receiving a drilling and sampling instruction, the mechanical arm 6 grabs an in-situ condition-preserved coring tool 8 from the rotary plate 9 and places the in-situ condition-preserved coring tool 8 onto the moon surface through the coring channel 4. Meanwhile, the hardness of the lunar soil on the moon surface is judged by the signal output from the hardness sensor 11. Then drilling and sampling are started after selecting an appropriate sampling point.

Figure 4:
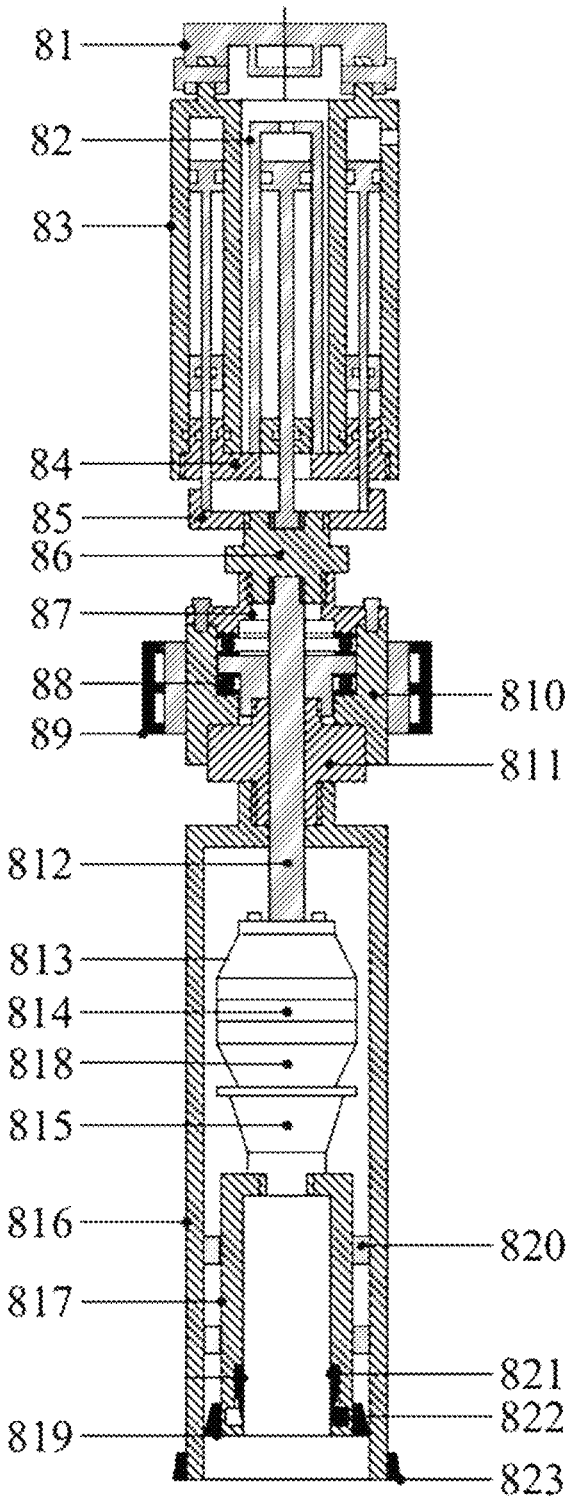
FIG. 4 illustrates a cross-sectional diagram on an in-situ condition-preserved coring tool 8 in FIG. 2.

Further, as shown in FIG. 4, the in-situ condition-preserved coring tool 8 comprises a tool body (not labeled), a multi-stage overlapping hydraulic cylinder mechanism (not labeled), a motor driving mechanism (not labeled), an ultrasonic shock power mechanism (not labeled), an external drilling mechanism (not labeled), and an internal drilling mechanism (not labeled). The multi-stage overlapping hydraulic cylinder mechanism is fixedly connected to the tool body. The motor driving mechanism is fixedly connected to the multi-stage overlapping hydraulic cylinder mechanism. The ultrasonic shock power mechanism is fixedly connected to the multi-stage overlapping hydraulic cylinder mechanism. The external drilling mechanism is fixedly connected to the motor driving mechanism. The internal drilling mechanism is fixedly connected to the ultrasonic shock power mechanism.

In the present embodiment, the multi-stage overlapping hydraulic cylinder mechanism is configured to drive the external drilling mechanism and the internal drilling mechanism to drill downward, before the external drilling mechanism and the internal drilling mechanism are able to reach a predetermined depth. While the multi-stage overlapping hydraulic cylinder mechanism is driving the external drilling mechanism to drill downward, the external drilling mechanism is driven to rotate by the motor driving mechanism, to ensure a smooth excavation of the external drilling mechanism. When the multi-stage overlapping hydraulic cylinder mechanism drives the internal drilling mechanism to drill downward, if a hard rock layer is encountered, a vibrational cut from the ultrasonic shock power mechanism is provided to the internal drilling mechanism to help complete the coring of the hard rock layer.

Further, as shown in FIG. 4, the multi-stage overlapping hydraulic cylinder mechanism comprises a hollow servo cylinder 83, a pneumatic servo cylinder 82, a connection shell 85, and a drilling pressure sensor 86.

In the present embodiment, the number of the hollow servo cylinders 83 is two, two of the hollow servo cylinders 83 are respectively arranged at both sides of the pneumatic servo cylinder 82, and fixedly connected to the tool body respectively by pins or screws. Each of the hollow servo cylinders 83 has a servo cylinder base 84 arranged at a bottom. One end of the pneumatic servo cylinder 82 is fixedly connected to one of the servo cylinder bases 84, and another end of the pneumatic servo cylinder 82 is fixedly connected to another one of the servo cylinder bases 84.

In the present embodiment, among two of the hollow servo cylinders 83, a push rod of one of the hollow servo cylinders 83 is fixed to one end of the connection shell 85, and a push rod of another one of the hollow servo cylinders 83 is fixed to another end of the connection shell 85. The bottom of the connection shell 85 has the drilling pressure sensor 86 arranged, and fixedly connected to the connection shell 85.

The hollow servo cylinder 83 is configured to push the motor driving mechanism connected thereto to drive the external drilling mechanism below the motor driving mechanism to drill downward. During an operation of the hollow servo cylinder 83, a downward pressure is applied to the external drilling mechanism so that the external drilling mechanism can go deep into an interior of the lunar soil. The pneumatic servo cylinder 82 is used to push the ultrasonic shock power mechanism connected thereto to drill downward. If a hard rock layer is encountered during the operation of the pneumatic servo cylinder 82, a vibrational cut is generated onto the internal drilling mechanism by the ultrasonic shock power mechanism, to help complete a coring work to the hard rock layer. The drilling pressure sensor 86 is configured to sense a size of the pressure during drilling, thereby adjusting the pressure of depression of the hollow servo cylinder 83 and the pneumatic servo cylinder 82 according to the size of pressure.

Further, the motor driving mechanism comprises a driving housing 87, a hollow stator 810, a hollow rotor 811, and a thrust bearing set 88. The driving housing 87 bears the drilling pressure sensor 86 and is fixedly connected to the drilling pressure sensor 86. The hollow stator 810 is fixedly connected to the driving housing 87, the thrust bearing set 88 is fixedly connected to the hollow stator 810, and the hollow rotor 811 is fixedly connected to the thrust bearing set 88.

In the present embodiment, the motor driving mechanism is used to drive the external drilling mechanism below to rotate, and drive the external drilling housing 816 in the external drilling mechanism to rotate by the hollow rotor 811, thereby driving the external drill 823 below the external drilling housing 816 to excavate. The thrust bearing set 88 is fixed in the hollow stator 810, and the hollow rotor 811 is arranged on the thrust bearing set 88.

Further, in order to ensure a stability of the operation of the in-situ condition-preserved coring tool 8 in the coring channel 4, a sliding support structure 89 is arranged on a surface of the driving housing 87 and fixedly connected to the driving housing 87. When the mechanical arm 6 places the in-situ condition-preserved coring tool 8 into the coring channel 4, the sliding support structure 89 is expanded for a tight contact with an internal wall of the coring channel 4, therefore the in-situ condition-preserved coring tool 8 is fixed to the internal wall of the coring channel 4. Meanwhile, the tool body of the in-situ condition-preserved coring tool 8 is axially movable by a certain distance along the internal wall of the sliding support structure 89. By a support action of the sliding support structure 89, the in-situ condition-preserved coring tool 8 can be stably operated in the coring channel 4.

Further, the ultrasonic shock power mechanism comprises a connection rod 812, an upper cover plate 813, a piezoelectric ceramic 814, a lower cover plate 818, and an amplitude changing rod 815. The connection rod 812 passes through a center of the hollow rotor 811 and the connection shell 85, and a top of the connection rod 812 is fixedly connected to the push rod of the pneumatic servo cylinder 82. When the connection rod 812 passes through the center of the hollow rotor 811 and the connection shell 85, both the hollow rotor 811 and the connection shell 85 has a bearing arranged correspondingly at a center thereof. A bottom of the connection rod 812 is fixedly connected to the upper cover plate 813, the piezoelectric ceramic 814 is fixedly connected to the upper cover plate 813, the lower cover plate 818 is fixedly connected to the piezoelectric ceramic 814, and the amplitude changing rod 815 is fixedly connected to the lower cover plate 818.

In the present embodiment, the connection rod 812 bears the push rod of the pneumatic servo cylinder 82, and transmits a drilling pressure of the pneumatic servo cylinder 82 to the amplitude changing rod 815, making the amplitude changing rod 815 be able to drive the internal drilling mechanism below to drill downward. When the internal drilling mechanism is drilling downward, if a hard rock layer is encountered, through the shock generated by the piezoelectric ceramic 814, the amplitude-changing rod 815 will be made to drive the internal drilling mechanism to cut downward, thereby completing a coring work to the hard rock layer.

Further, the external drilling mechanism comprises an external drill housing 816 and an external drill 823; wherein a top of the external drill housing 816 bears the hollow rotor 811 and fixedly connects to the hollow rotor 811. When the hollow rotor 811 rotates, the external drill housing 816 will be driven to rotate together. The external drill 823 is arranged at a bottom of the external drill housing 816, and fixedly connected to the external drill housing 816. When the external drill housing 816 rotates, through cutting by the external drill 823, a drill hole with a predetermined size can be drilled on the moon surface.

Further, the internal drilling mechanism comprises an internal drill housing 817, an internal drill 819, a claw 821, and a sealing airbag 822. A top of the internal drill housing 817 bears the amplitude changing rod 815 and fixedly connects to the amplitude changing rod 815. The internal drill housing 817 has the internal drill 819 arranged at a bottom and fixedly connected to the internal drill housing 817. The internal drill housing 817 has the claw 821 arranged on an internal wall, and rotatably connects to the internal drill housing 817. Outside the claw 821, that is, between the claw 821 and the internal wall of the internal drill housing 817, there is the sealing airbag 822 arranged. The sealing airbag 822 is fixedly connected to the internal drill housing 817.

In the present embodiment, when the internal drilling mechanism drills downward and encounters a hard rock layer, it is possible to control the ultrasonic shock power mechanism to generate a shock, so as to drive the internal drill 819 to cut downward and take coring of the hard rock layer. When the internal drilling mechanism has completed the coring operation (i.e., drilling the hard rock has been completed), the claw 821 is controlled to snap the core of the hard rock layer. Further, the sealing airbag 822 on the external side of the claw 821 is controlled to expand and fill a sealing groove in the internal drilling mechanism. Since an environment on the moon is a near-vacuum environment while the environment on the earth is a high-pressure environment, when the in-situ condition-preserved coring tool 8 is brought back to the earth, the sealing airbag 822 will form a self-sealing state under an atmospheric pressure of the earth.

Further, between the internal drill housing 817 and the external drill housing 816, a guiding support structure 820 is arranged. The guiding support structure 820 is fixedly connected to the internal drill housing 817, and slidably connected to the external drill housing 816. The guiding support structure 820 may be configured to guide and support the internal drill housing 817. By arranging the guiding support structure 820 between the internal drill housing 817 and the external drill housing 816, it is possible to ensure a stability of drilling by the internal drill housing 817, and a lateral vibration of the internal drill housing 817 can be reduced, when the ultrasonic shock power mechanism vibrates.

Further, a suspension joint 81 is arranged on a top of the tool body, and fixedly connected to the hollow servo cylinder 83. After the coring operation of the in-situ condition-preserved coring tool 8 is completed, the in-situ condition-preserved coring tool 8 is retrieved by a rope device (not shown) in the moon-based in-situ condition-preserved coring multi-stage large-depth drilling system 2. When the rope device is lowered into the coring channel 4, the suspension joint 81 is hooked, and then the in-situ condition-preserved coring tool 8 is pulled and placed back onto the rotary plate 9.

In the present embodiment, an operation principle of the in-situ condition-preserved coring tool 8 is as follows:

When the in-situ condition-preserved coring tool 8 is placed on the moon surface, a sampling and drilling operation will be initiated, and during the sampling and drilling operation, the hollow servo cylinder 83 in the multi-stage overlapping hydraulic cylinder mechanism generates a downward thrust under an action of an air pressure, thereby forming a drilling pressure required for drilling. The drilling pressure is transmitted downward through the connection shell 85 and the drilling pressure sensor 86, while being transferred to the external drill housing 816 by the motor driving mechanism. Driven by the external drill housing 816, the external drill 823 is pushed to drill downward. While at the same time, under an action of a self-carried power supply in the in-situ condition-preserved coring tool 8, the motor driving mechanism starts to work, the hollow rotor 811 rotates around the connection rod 812 to make a rotation around a fixed axis, and transfers a torque generated by the hollow rotor 811 to the external drill housing 816. Driven by the external drill housing 816, the external drill 823 makes a rotation action. Under an action of the hollow servo cylinder 83 and the hollow rotor 811, the external drill 823 performs a rotary drilling action.

During the coring process of the in-situ condition-preserved coring tool 8, if a hard rock layer is encountered, the piezoelectric ceramic 814 and the amplitude changing rod 815 in the ultrasonic shock power mechanism generate an ultrasonic shock under an action of an electric current, and transmits the shock to the internal drill housing 817, and the internal drill housing 817 then transmits the shock to the internal drill 819. While at the same time, the connection rod 812 receives and bears the drilling pressure from the pneumatic servo cylinder 82 and transmits the drilling pressure to the internal drill 819, to make an ultrasonic vibration cut to the hard rock layer. By a high-speed cutting action of the ultrasonic shock power mechanism, a drilling efficiency of a sampling is improved.

When a stroke of drilling and coring is completed, the sliding support structure 89 is controlled to contract and enter a next stroke. When carrying out the next stroke, the sliding support structure 89 opens again, expands and contacts tightly with the internal wall of the coring channel, to start a new round of the drilling operation until finishing the coring.

When the coring is completed, the claw 821 is controlled to snap the core of the hard rock layer. At the same time, the sealing airbag 822 on the external side of the claw 821 expands and fills the sealing groove in the internal drilling mechanism.

When a sampling operation is completed, a sample of the lunar soil is enclosed in the in-situ condition-preserved coring tool 8 and kept in an original performance state. At the same time, the rope device is controlled to go down and enter the coring channel 4, hook with the suspension joint 81, and take back the in-situ condition-preserved coring tool 8 filled with samples, before placing on the rotary plate 9. Then the working platform 5 is controlled to rotate while the mechanical arm 6 is controlled to move, before grabbing a next in-situ condition-preserved coring tool 8, and starting a new round of the coring work. During an entire coring process, it is possible to make a detailed observation by the camera 10, to ensure that the coring work by the in-situ condition-preserved coring tool 8 is carried out smoothly.

Embodiment 2

Figure 5:
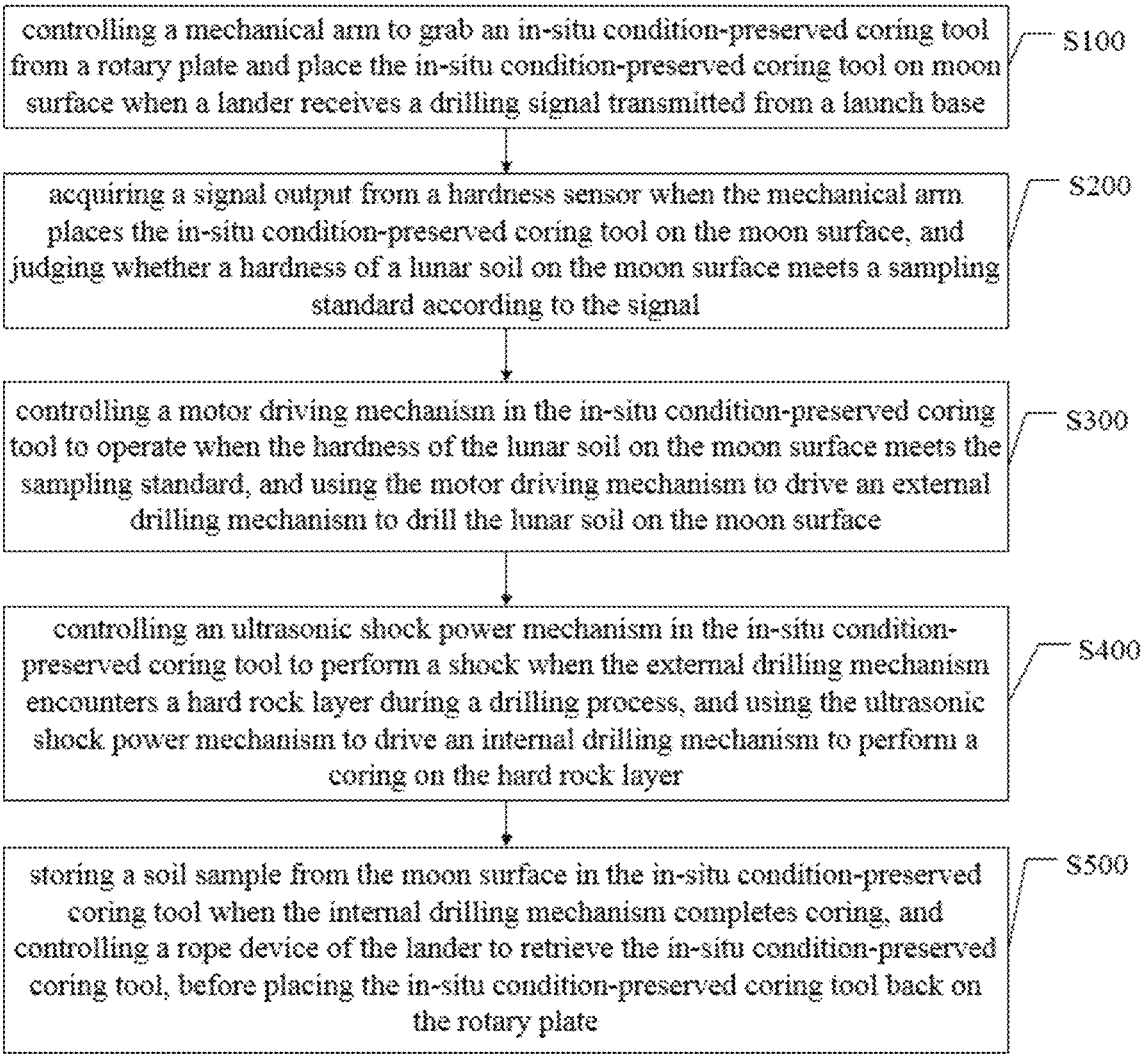
FIG. 5 illustrates a flow chart on a multi-stage large-depth drilling method for moon-based in-situ condition-preserved coring in an embodiment of the present disclosure.

The present embodiment provides a moon-based in-situ condition-preserved coring multi-stage large-depth drilling method, as shown in FIG. 5, comprising steps of:

Step 100: Controlling a mechanical arm to grab an in-situ condition-preserved coring tool from a rotary plate and place the in-situ condition-preserved coring tool on moon surface when a lander receives a drilling signal transmitted from a launch base. Detailed information is stated hereinabove.

Step 200: Acquiring a signal output from a hardness sensor when the mechanical arm places the in-situ condition-preserved coring tool on the moon surface, and judging whether a hardness of a lunar soil on the moon surface meets a sampling standard according to the signal. Detailed information is stated hereinabove.

Step 300: Controlling a motor driving mechanism in the in-situ condition-preserved coring tool to operate when the hardness of the lunar soil on the moon surface meets the sampling standard, and using the motor driving mechanism to drive an external drilling mechanism to drill the lunar soil on the moon surface by using the motor driving mechanism. Detailed information is stated hereinabove.

Step 400: Controlling an ultrasonic shock power mechanism in the in-situ condition-preserved coring tool to perform shock when the external drilling mechanism encounters a hard rock layer during a drilling process, and using the ultrasonic shock power mechanism to drive an internal drilling mechanism to perform a coring on the hard rock layer. Detailed information is stated hereinabove.

Step 500: Storing a soil sample from the moon surface in the in-situ condition-preserved coring tool when the internal drilling mechanism completes coring, and controlling a rope device of the lander to retrieve the in-situ condition-preserved coring tool, before placing the in-situ condition-preserved coring tool back on the rotary plate. Detailed information is stated hereinabove.

All above, by arranging the rotary plate, the in-situ condition-preserved coring tool, the space frame, the working platform, the mechanical arm and the camera inside the lander, the present disclosure controls the mechanical arm to place the in-situ condition-preserved coring tool on the moon surface, and uses the in-situ condition-preserved coring tool to sample soil, rocks and more on the moon surface, before solving a problem of coring work on the lunar soil, and achieving the operation of collecting, excavating and transporting the lunar soil in an in-situ condition-preserved state, as well as increasing a sampling amount of the lunar soil coring.

It is to be understood that the embodiments of the present disclosure are not limited to the above embodiments, and that modifications or changes may be made to those skilled in the art in light of the above description, all of which are intended to fall within the scope of the appended claims of the present disclosure.

What is claimed is:

1. A multi-stage large-depth drilling system for moon-based in-situ condition-preserved coring, comprising: a rotary plate arranged inside a lander and rotatably connected to the lander, an in-situ condition-preserved coring tool arranged on a surface of the rotary plate, the in-situ condition-preserved coring tool configured to sample the lunar soil, a space frame disposed on the surface of the rotary plate and fixedly connected to the rotary plate, a working platform arranged on a top of the space frame and rotatably connected to the space frame, a mechanical arm arranged on a bottom surface of the working platform which is configured to grasp the in-situ condition-preserved coring tool, and a camera arranged on a bottom surface of the working platform which is configured to observe a moon surface; the mechanical arm is fixedly connected to the working platform, and the camera is fixedly connected to the working platform.

2. The system according to claim 1, wherein the mechanical arm is a multi-degree-of-freedom mechanical arm, wherein a hardness sensor is fixedly connected to a tail of the mechanical arm.

3. The system according to claim 1, wherein the in-situ condition-preserved coring tool comprises a tool body, a multi-stage overlapping hydraulic cylinder mechanism, a motor driving mechanism, an ultrasonic shock power mechanism, an external drilling mechanism, and an internal drilling mechanism; and the multi-stage overlapping hydraulic cylinder mechanism is fixedly connected to the tool body; the motor driving mechanism is fixedly connected to the multi-stage overlapping hydraulic cylinder mechanism; the ultrasonic shock power mechanism is fixedly connected to the multi-stage overlapping hydraulic cylinder mechanism; the external drilling mechanism is fixedly connected to the motor driving mechanism; and the internal drilling mechanism is fixedly connected to the ultrasonic shock power mechanism.

4. The system according to claim 3, wherein the multi-stage overlapping hydraulic cylinder mechanism comprises a hollow servo cylinder, a pneumatic servo cylinder, a connection shell, and a drilling pressure sensor; and the hollow servo cylinder is arranged on both sides of the pneumatic servo cylinder, and the hollow servo cylinder is fixedly connected to the tool body; a bottom of the pneumatic servo cylinder is fixedly connected to a base of the hollow servo cylinder; the connection shell is fixedly connected to a push rod of the hollow servo cylinder; and the drilling pressure sensor is fixedly connected to the connection shell.

5. The system according to claim 4, wherein the motor driving mechanism comprises a driving housing, a hollow stator, a hollow rotor, and a thrust bearing set; and the driving housing is fixedly connected to the drilling pressure sensor; the hollow stator is fixedly connected to the driving housing; the thrust bearing set is fixedly connected to the hollow stator; and the hollow rotor is fixedly connected to the thrust bearing set.

6. The system according to claim 5, wherein the ultrasonic shock power mechanism comprises a connection rod, an upper cover plate, a piezoelectric ceramic, a lower cover plate, and an amplitude changing rod; and the connection rod passes through a center of the hollow rotor and the connection shell, and a top of the connection rod is fixedly connected to the push rod of the pneumatic servo cylinder; the upper cover plate is fixedly connected to the connection rod, the piezoelectric ceramic is fixedly connected to the upper cover plate, and the lower cover plate is fixedly connected to the piezoelectric ceramic; and the amplitude changing rod is fixedly connected to the lower cover plate.

7. The system according to claim 6, wherein the external drilling mechanism comprises an external drill housing and an external drill; and a top of the external drill housing is fixedly connected to the hollow rotor; and the external drill is arranged at a bottom of the external drill housing and fixedly connected to the external drill housing.

8. The system according to claim 7, wherein the internal drilling mechanism comprises an internal drill housing, an internal drill, a claw, and a sealing airbag; and the internal drill housing is fixedly connected to the amplitude changing rod; the internal drill is arranged at a bottom of the internal drill housing and fixedly connected to the internal drill housing; the claw is arranged on an internal wall of the internal drill housing and rotatably connected to the internal drill housing; the sealing airbag is arranged outside the claw and fixedly connected to the internal drill housing.

9. The system according to claim 8, wherein a guiding support structure is arranged between the internal drill housing and the external drill housing, and the guiding support structure is fixedly connected to the internal drill housing and slidably connected to the external drill housing.

10. A method for moon-based in-situ condition-preserved coring multi-stage large-depth drilling, comprising:

controlling a mechanical arm to grab an in-situ condition-preserved coring tool from a rotary plate and place the in-situ condition-preserved coring tool on a moon surface when a lander receives a drilling signal transmitted from a launch base;

acquiring a signal output from a hardness sensor when the mechanical arm places the in-situ condition-preserved coring tool on the moon surface, and judging whether a hardness of a lunar soil on the moon surface meets a sampling standard according to the signal;

controlling a motor driving mechanism in the in-situ condition-preserved coring tool to operate when the hardness of the lunar soil on the moon surface meets the sampling standard, and using the motor driving mechanism to drive an external drilling mechanism to drill the lunar soil on the moon surface;

controlling an ultrasonic shock power mechanism in the in-situ condition-preserved coring tool to perform a shock when the external drilling mechanism encounters a hard rock layer during a drilling process, and using the ultrasonic shock power mechanism to drive an internal drilling mechanism to perform a coring on the hard rock layer; and storing a soil sample from the moon surface in the in-situ condition-preserved coring tool when the internal drilling mechanism completes coring, and controlling a rope device of the lander to retrieve the in-situ condition-preserved coring tool, before placing the in-situ condition-preserved coring tool back on the rotary plate.

* * * * *